US005439270A

United States Patent [19]

Owen

[11] Patent Number: 5,439,270

[45] Date of Patent: Aug. 8, 1995

[54] STATIC CHAIR

[76] Inventor: Earl R. Owen, Microsurgery Centre, 1 Esther Street, Surry Hills NSW 2010, Australia

[21] Appl. No.: 170,188

[22] PCT Filed: Jun. 24, 1992

[86] PCT No.: PCT/AU92/00311

§ 371 Date: Dec. 22, 1993

§ 102(e) Date: Dec. 22, 1993

[87] PCT Pub. No.: WO93/00029

PCT Pub. Date: Jan. 7, 1993

[30] Foreign Application Priority Data

Jun. 24, 1991 [AU] Australia ..... PK6866

[51] Int. Cl.[6] ..... A47C 7/18

[52] U.S. Cl. ..... 297/452.27; 5/481; 5/653; 297/452.21

[58] Field of Search ..... 297/452.21, 452.22, 297/452.27, 452.32, 452.37; 5/464, 481, 653

[56] References Cited

U.S. PATENT DOCUMENTS

| | | | |
|---|---|---|---|
| 3,503,649 | 3/1970 | Johnson . | |
| 3,642,323 | 2/1972 | Taylor . | |
| 3,751,111 | 8/1973 | Taylor et al. . | |
| 3,987,507 | 10/1976 | Hall | 5/653 |
| 4,522,447 | 6/1985 | Snyder et al. | 297/452.27 |
| 4,696,516 | 9/1987 | Yeum | 297/452.27 X |
| 4,726,086 | 2/1988 | McEvoy | 5/464 |
| 4,835,801 | 6/1989 | Walpin et al. | 297/452.37 X |
| 4,837,881 | 6/1989 | Kondo et al. | 297/452.27 X |
| 5,085,488 | 2/1992 | Dal Monte | 297/452.37 X |

FOREIGN PATENT DOCUMENTS

| | | | |
|---|---|---|---|
| 2517960 | 6/1993 | France | 5/653 |
| 3402967 | 8/1985 | Germany | 297/452.27 |

OTHER PUBLICATIONS

Patents Abstracts of Japan, M1181, p. 14, JP, A, 3-193540 (Delta Togyo K.K.) 23 Aug. 1991.

*Primary Examiner*—Peter R. Brown
*Attorney, Agent, or Firm*—Ostrolenk, Faber, Gerb & Soffen

[57] ABSTRACT

A static chair designed to provide the user in both upright and slumped positions by the provision of different shaped layers of foam plastics material of different densities in various regions of the cushion and backrest. The cushion has a base layer of foam in which are inset two zones of lower density foam located in regions beneath the buttocks of a typical user in the upright and slumped positions respectively. The backrest is also contoured to provide lumbar support in both upright and slumped positions by the provision of foam material layers of different densities. The cushion and backrest are designed so that they may be substituted for materials in existing static chairs typically used in a theater situation without requiring total chair replacement.

9 Claims, 3 Drawing Sheets

STATIC CHAIR

TECHNICAL FIELD

This invention relates to a static chair and has been devised particularly though not solely for a mass seating application.

BACKGROUND ART

In many mass seating situations such as concert halls, theatres, or opera chambers, individual seats on fixed bases are provided for the patrons. Such seats commonly have a shell supporting the seat and backrest portions and the seat portion may be designed to tip up to allow access along narrow rows.

The cushion and backrest on seats of this type are typically designed to suit an average person seated in an upright position. During long performances, it is common for patrons to become uncomfortable and/or restless and to slump in their seats into a position where the chair no longer provides the desirable anatomic support.

It is possible to overcome this problem using so-called dynamic seats which have adjustable seat and backrest portions but it is generally impossible or impractical to incorporate any form of dynamic seating in a fixed mass seating situation such as a concert chamber or theatre.

It is therefore an object of the present invention to provide a static seat which will give some of the advantages of a dynamic seat, and comfortably support users of different sizes in either upright or slumped positions.

DISCLOSURE OF THE INVENTION

The present invention therefore provides a seat having a cushion formed from resilient foam material comprising a base layer of foam of predetermined density and at least two zones of relatively low density foam inset into the upper face of the base layer, the first said zone being positioned so as to be located beneath the buttocks of a typical user seated in an upright position and the second said zone being positioned so as to be located beneath the buttocks of a typical user seated in a slumped position.

Preferably said zones are substantially oval in plan view having longer and shorter axes, the longer axis being orientated transversely across the cushion.

Preferably said first and second zones overlap one another.

Preferably the front edge of the cushion is formed from a region of foam having a lower density relative to the base layer foam.

Preferably the upper face of the front edge region is curved outwardly and downwardly from the upper face of the base layer.

Preferably the cushion further comprises at least one foundation layer of foam beneath the base layer, the foundation layer foam having a higher density than the base layer foam.

Preferably the seat incorporates a backrest formed from resilient foam material comprising a lumbar support region positioned so as to be located across the lumbar region of a typical user seated in an upright position, and a lower region located beneath the lumbar region, the lower region foam having a lower density than the lumbar support region foam.

Preferably the lumbar support region tapers in thickness upwardly from the lumbar region of a typical user and is overlaid by an upper back support region which tapers in thickness downwardly from the top of the backrest, the upper back support region foam having a lower density than the lumbar support region foam.

Preferably the forward face of the backrest is generally concave in horizontally section.

BRIEF DESCRIPTION OF DRAWINGS

Notwithstanding any other forms that may fall within its scope, on preferred form of the invention will now be described by way of example only with reference to the accompanying drawings, in which.

MODES FOR CARRYING OUT THE INVENTION

Figure 1:
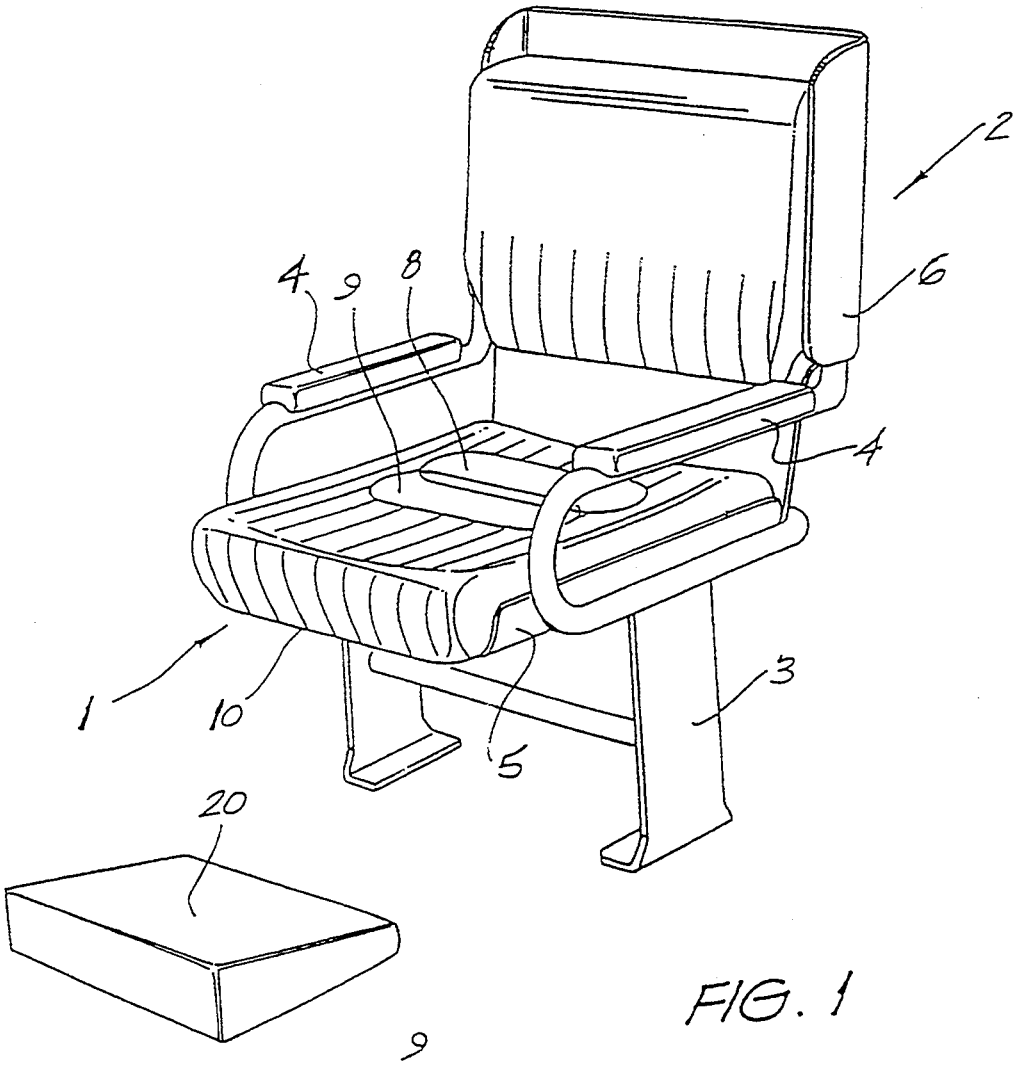
FIG. 1 is a diagrammatic perspective view of a static theatre seat according to the invention.

In the preferred form of the invention a static seat having a cushion portion (1) and a backrest portion (2) is designed for use in a fixed theatre situation and may typically be mounted on a pedestal base (3). The seat is also typically provided with arm rests (4) and the seat portion (1) may be designed to tip up for easy access along narrow rows.

The cushion portion (1) may be supported on a frame or shell (5) and similarly the backrest portion (2) may be supported by a frame or a shell (6).

The cushion portion is formed from resilient foam material (typically foamed plastics material) and comprises a base layer (7) of foam of predetermined density. Two zones (8) and (9) of lower density foam are provided inset into the upper face of the base layer (7) and positioned so that the first zone (8) is positioned beneath the buttocks of a typical user seated in an upright position, and the second zone (9) is positioned beneath the buttocks of a typical user seated in a slumped position.

Figure 2:
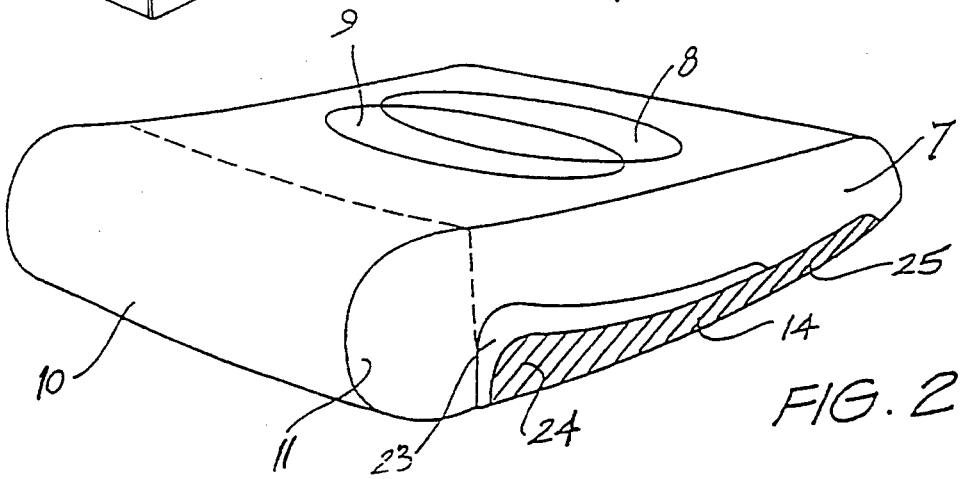
FIG. 2 is a perspective partial view of the cushion of the seat shown in FIG. 1.

The zones (8) and (9) may be any desirable shape in plan view but are typically oval in plan view with the longer axis of the oval orientated transversely across the cushion as may be seen in FIGS. 1 and 2.

As can also be clearly seen from the drawings, the first and second zones overlap one another in this particular example.

The front edge (10) of the cushion is formed from a region of foam (11) which may have a lower density relative to the density of the foam in the base layer (7). Alternatively the base layer (7) may simply extend into the front edge region (11). The upper face (12) of the front edge region is curved outwardly and downwardly from the upper face (13) of the base layer.

In order to prevent "bottoming" of the seat cushion under the weight of a heavy user, a foundation layer (14) may also be provided beneath the base layer. The foundation layer foam has a higher density than the foam in the base layer (7). The foundation layer (14) is preferably shaped in front-to-back profile so as to have a thicker portion (24) in the area beneath the thighs of a typical user, and a relatively thinner area (35) in the region beneath the buttocks of a typical user. This shape is clearly seen in FIG. 2.

Figure 2A:
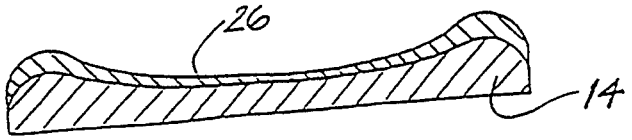
FIG. 2A is a transverse cross-section through the foundation layer of the cushion in the region under the soft zones.

It is also desirable to shape the foundation foam (14) in transverse section as shown in FIG. 2A so that the foundation layer has a concave upper surface (26) in transverse section beneath the zones (8) and (9) of relatively low density foam.

In some seating situations it may also be desirable to also provide an intermediate layer of foam (23) interposed between the foundation layer (25) and the base layer (7) and having a density which is intermediate the density of the foundation layer (14) and the base layer (7). The intermediate layer is shaped to the profile shown in FIG. 2 having a relatively thick portion under the thigh region of a typical user and a relatively thin portion under the zones (8) and (9).

The backrest (2) is also formed from resilient foam material comprising a lumbar support region (15) positioned so as to be located across the lumber region of a typical user seated in an upright position, and a lower region (16) located beneath the lumbar region, the foam of the lower region (16) having a lower density than the foam of the lumber support region (15).

The upper portion of the lumbar support region (15) tapers in thickness upwardly from the lumbar region as shown at (17) and is overlaid by an upper back support region (18) which tapers in thickness downwardly from the top of the backrest (19), the upper back support region (18) being formed of foam having a lower density than the foam of the lumbar support region (15).

Figure 5:
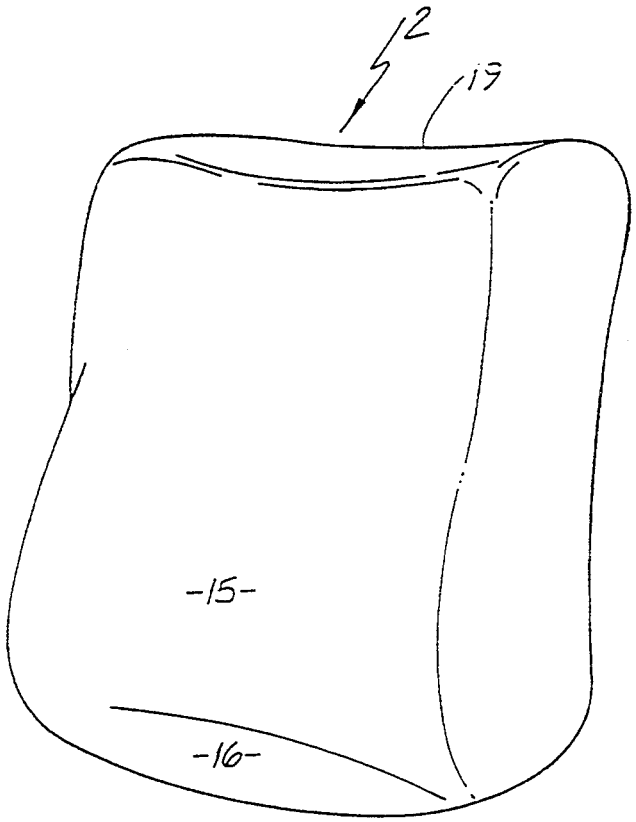
FIG. 5 is a diagrammatic perspective view of the backrest portion of the seat shown in FIG. 1.
Figure 6:
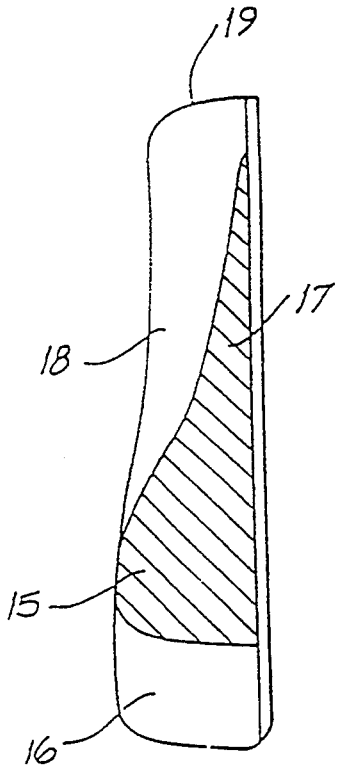
FIG. 6 is a vertical cross-section through the backrest portion shown in FIG. 5.
Figure 7:
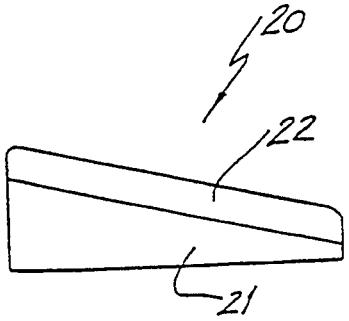
FIG. 7 is a vertical section through a foot rest designed for use with the seat shown in FIG. 1.

The backrest is generally concave in horizontal section as can be seen in FIG. 5.

When a user sits in the seat in a upright position, the buttocks of the user are located in the low density zone (8) providing a comfortable cushion beneath the buttocks. The lumbar support region (15) supports the lumbar forward curve of the spine and the lower region (16), being relatively soft, allows the backside of the user to tuck in under the lumbar support region when sitting up. Although the upper back support region (18) is of relatively soft foam, there is little weight on this region when sitting in an upright position and the backrest therefore feels relatively firm to the user.

When the user reclines into a slumped position, the buttocks are comfortably located within the soft zone (9), the backside is supported by the lower region (16), and the relatively soft foam in the upper back support region (18) compresses giving comfortable support in the slumped position.

In this manner, the static chair gives comfortable support to the user in both upright and slumped positions enabling the user to adjust his position for comfort while being adequately supported at all times.

Figure 3:
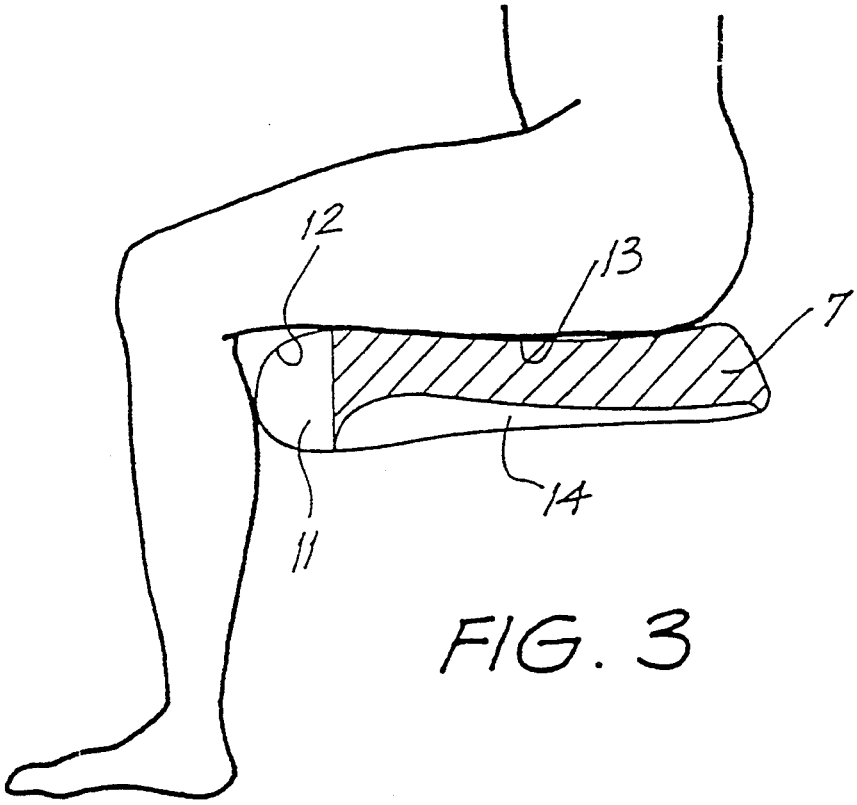
FIG. 3 is a vertical section through the cushion shown in FIG. 2, showing a long legged user seated on the cushion.
Figure 4:
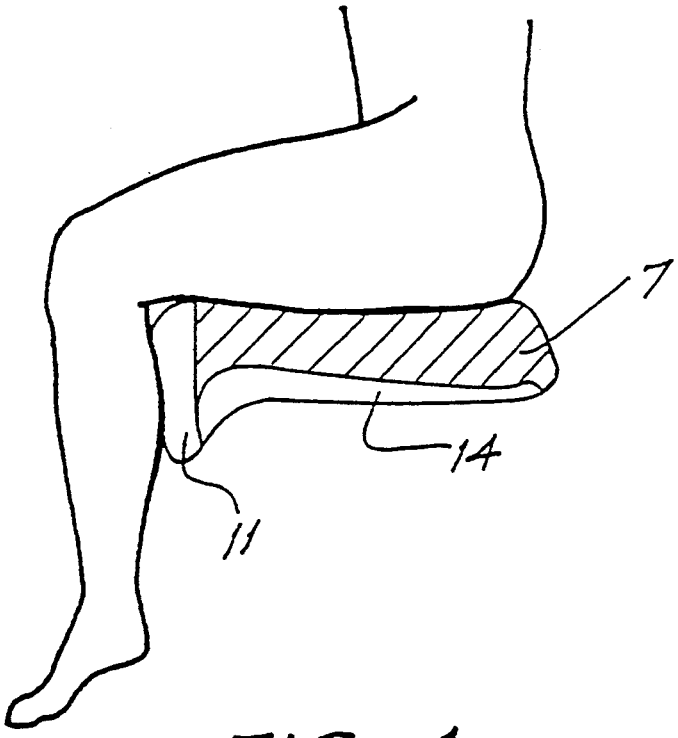
FIG. 4 is a similar view to FIG. 3 showing a short legged user seated on the cushion.

The chair according to the invention is also comfortable for both long legged and short legged users due to the nature of the front edge portion (11). The soft foam of the front edge portion gives the impression of a long seat for long legged users as shown in FIG. 3, but collapses onto the harder density foam of the base layer (7) with shorter legged people as shown in FIG. 4.

The high density foam (14) in the foundation layer prevents bottoming of the seat even with heavy users.

Figure 8:
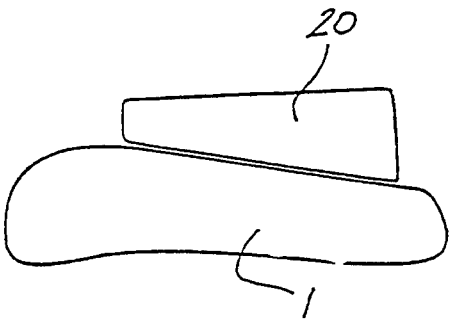
FIG. 8 is a diagrammatic vertical section showing the use of the foot rest as a bolster cushion.

As an optional feature, the seat may also be provided with a wedge-shaped foot rest (20) formed from a relatively high density base layer (21) and a lower density covering layer (22). The foot rest (which may be tucked away under the seat when not in use) not only enhances the comfort of short legged users but also may be placed on top of the seat cushion as shown in FIG. 8 to allow small children to sit up and see the stage.

The static seat according to the invention not only has the advantage that it gives the comfort of a dynamic seat and allows the user to be comfortably supported in both upright and slumped positions, but furthermore due to the unitary nature of both the cushion (1) and the backrest (2), these portions may readily be substituted for conventional cushions and backrests in existing theatre seats. The invention therefore enables the use of existing theatre seat frameworks and shells to be readily converted into the comfortable static seat configuration.

I claim:

1. A seat comprising a seating cushion formed from resilient foam material and having a front edge, a rear edge, and a base layer, the base layer being formed of foam of a predetermined density and having an upper face, the upper face having first and second zones of foam of a density relatively lower than the predetermined density foam of the base layer, the two zones being inset into the upper face of the base layer, the first zone being positioned toward the rear edge of the cushion so as to be located beneath the buttocks of a typical user seated in an upright position, and the second zone being positioned toward the front edge of the cushion with respect to the first zone so as to be located beneath the buttocks of a typical user seated in a slumped position, the first and second zones being substantially oval in plan view, and having a longer axis and a shorter axis, the longer axis being oriented transversely across the cushion.

2. A seat as claimed in claim 1 wherein said first and second zones overlap one another.

3. A seat as claimed in claim 1 wherein the front edge of the cushion is formed from a region of foam having a lower density relative to the predetermined density of the base layer foam.

4. A seat as claimed in claim 1 wherein the cushion further comprises at least one foundation layer of foam beneath the base layer, the foundation layer foam having a higher density than the predetermined density of the base layer foam.

5. A seat as claimed in claim 4 wherein the foundation layer is thicker toward the front edge than toward the rear edge, such that the foundation layer is thicker beneath a thigh region of the typical user than beneath the buttocks of the user.

6. A seat as claimed in claim 4 wherein the foundation layer has a concave upper surface in transverse section beneath the first and second zones of relatively low density foam.

7. A seat as claimed in claim 1 wherein the seat incorporates a backrest having a top and a forward face, the backrest being formed from resilient foam material, the backrest comprising a lumbar support region made of foam and positioned substantially co-planar with and along the rear edge of the cushion so as to be located across a lumbar region of the typical user seated in the upright position, and a lower region located beneath the lumbar region, the lower region foam having a lower density than the density of the lumbar support region foam.

8. A seat as claimed in claim 7 wherein the lumbar support region tapers so as to be reduced in thickness upwardly from the lower region and is overlaid by an upper back support region which tapers so as to be reduced in thickness downwardly from the top of the backrest, the upper back support region foam having a lower density than the density of the lumbar support region foam.

9. A seat as claimed in claim 8 wherein the forward face of the backrest is generally concave in horizontal section.

* * * * *